US005738077A

United States Patent [19]

Kim

[11] Patent Number: 5,738,077

[45] Date of Patent: Apr. 14, 1998

[54] FUEL INJECTION SYSTEM FOR A VEHICLE

[75] Inventor: Myong-Hwan Kim, Seoul, Rep. of Korea

[73] Assignee: Kia Motors Corporation, Seoul, Rep. of Korea

[21] Appl. No.: 682,061

[22] Filed: Jul. 16, 1996

[30] Foreign Application Priority Data

Apr. 18, 1996 [KR] Rep. of Korea ..... 1996-11740

[51] Int. Cl.[6] ..... F02B 23/00

[52] U.S. Cl. ..... 123/585

[58] Field of Search ..... 123/531, 533, 123/585

[56] References Cited

U.S. PATENT DOCUMENTS 4,841,942 6/1989 McKay ..... 123/531

*Primary Examiner*—Noah P. Kamen

[57] ABSTRACT

A fuel injection system including an air induction tube connected to an intake manifold, an air suction tube leading therefrom mounted on an injector, interfacing with an air passage concentrically around a fuel supply tube and an injection hole of a valve seat, and a ring-shaped valve formed on an outer circumference of the fuel supply tube and having a diameter slightly larger than or equal to that of the air passage to open and close the air passage. When the engine operates, application of electricity to magnetize a solenoid coil results in a plunger being lifted within the injector, opening the air passage. The front end of the air passage is flared to comply with an injection angle of the nozzle such that when fuel is injected through the nozzle of the needle valve, air fed from the air passage can surround the fuel, resulting in a stratified mixture of fuel and air.

6 Claims, 6 Drawing Sheets

FUEL INJECTION SYSTEM FOR A VEHICLE

FIELD OF THE INVENTION

The present invention relates to a fuel injection system, and more particularly, to a fuel injection system which can stratify a mixture of fuel and air injected from an injector into a combustion chamber by supplying additional air to the mixture.

BACKGROUND OF THE INVENTION

Generally, a fuel injection system is used to inject fuel into a combustion chamber of an engine, where the fuel is burned to obtain power required for driving a vehicle.

As shown in FIG. 1 (prior art), conventionally an injector 1 is mounted on an intake manifold 3 in which a throttle valve 2 is mounted. When the engine operates, fuel is injected from the injector 1 into the intake manifold 3, is mixed with air flowing through the intake manifold 3 via the throttle valve 2, thereby forming a mixture. This mixture enters the combustion chamber 4, and is then ignited by a spark from spark plug 5 and combusted.

The injector 1, as shown in FIG. 2, comprises a housing 6 and a solenoid coil 8 which is housed therein and is magnetized by electricity inputted from a separate electric source. When a plunger 9 is lifted by the solenoid coil 8, a needle valve 7 is lifted, and fuel is injected into the intake valve 17 through an injection hole 12. During operation of the engine, as shown in FIG. 3, the fuel injected into the intake manifold 3 through the injector 1 is mixed with air passing within the intake manifold 3. This mixture is then sprayed into a combustion chamber 4 by way of an intake valve 17 mounted on the intake manifold 3.

However, since the fuel injection system described above has a maximum air-fuel ratio of about 14.7:1, it cannot be applied to a lean-burn system which in intended to use an air-fuel mixture having a ratio greater than 14.7:1. In other words, the fuel injection system described above cannot stratify the air-fuel mixture fed to the combustion chamber, this stratification is returned when the system is applied to a lean-burn engine which uses an air-fuel mixture having a ratio of about 25:1. The conventional non-stratified mixture cannot normally be burned into the lean-burn state due to the differential in air-fuel ratio.

For the preceding reasons, there is a need for a fuel injection system which can obtain an air-fuel ratio which is suitable for use in a lean-burning engine.

SUMMARY OF THE INVENTION

The present invention is directed to a fuel injection system that satisfies the need for a suitable air-fuel ratio for use in lean-burn engines. The fuel injection system comprises an air intake manifold and an air induction tube extending between the manifold and a fuel injector. The air induction tube communicates with an outer concentric ring-shaped air passage formed around a fuel passageway which leads to a valved injection hole. A ring-shaped value is formed on an outside circumference of the fuel passageway. It has a diameter that is slightly larger than or equal to that of the outer concentric air passage to thereby open and close the air passage. When the engine operates, by applying electricity to a solenoid coil to magnetize it, a plunger (the fuel passageway) is lifted, thereby opening both the air passage and the fuel needle valve.

According to a feature of the present invention, a front end of the air passage is flared out to comply with an injection angle of the nozzle such that when fuel is injected through the nozzle of the needle valve, air that is fed from the air passage can surround the fuel.

BRIEF DESCRIPTION OF DRAWINGS

These and other features, aspects, and advantages of the present invention will become better understood with regard to the following description, appended claims, and accompanying drawings wherein:

DETAILED DESCRIPTION

Figure 1:
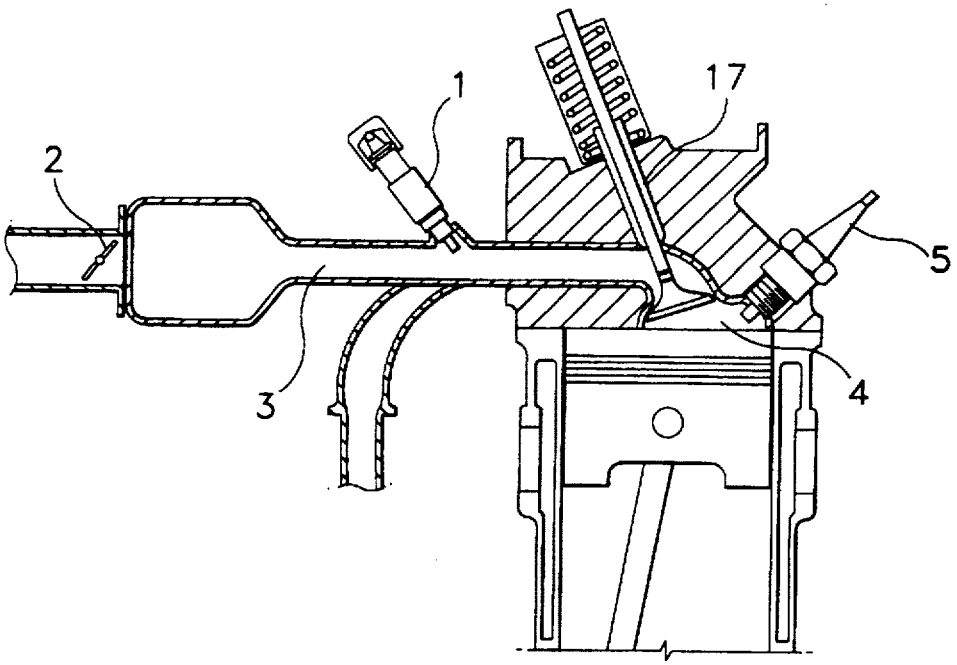
FIG. 1 PRIOR ART
FIG. 1 is a schematic view illustrating a conventional automotive injector mounted on an intake manifold of an engine.
Figure 2:
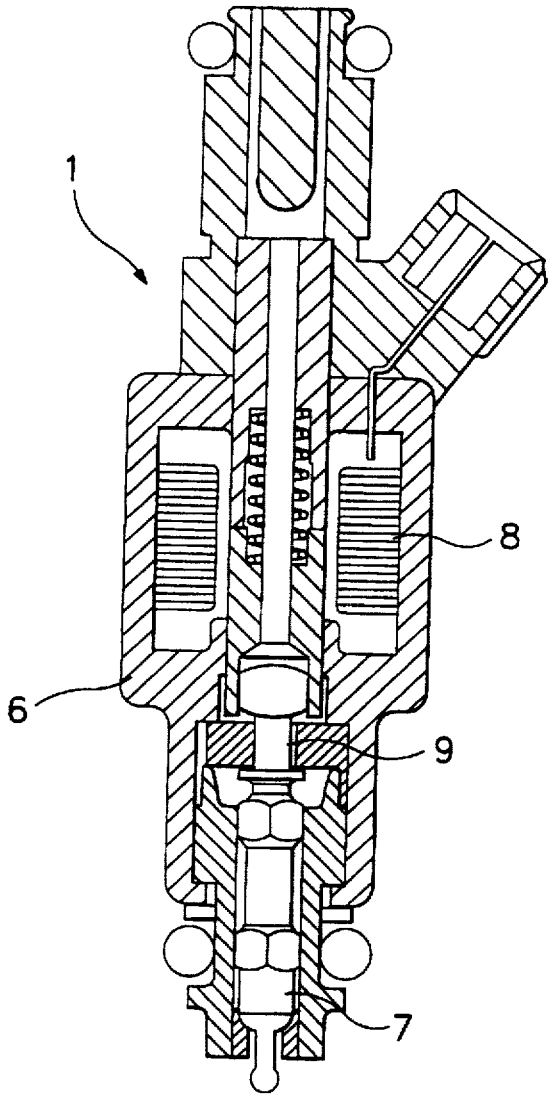
FIG. 2 PRIOR ART
FIG. 2 is a sectional view illustrating the injector depicted in FIG. 1.
Figure 3:
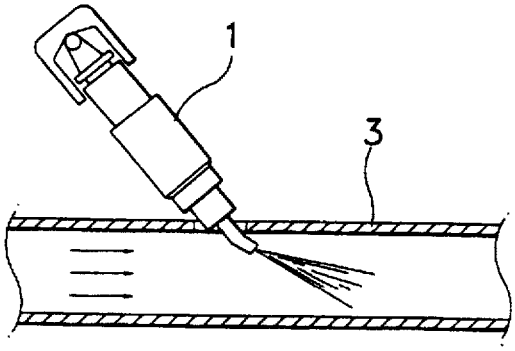
FIG.3 PRIOR ART
FIG. 3 is a sectional view illustrating a fuel injecting state from the injector depicted in FIG. 1.
Figure 4:
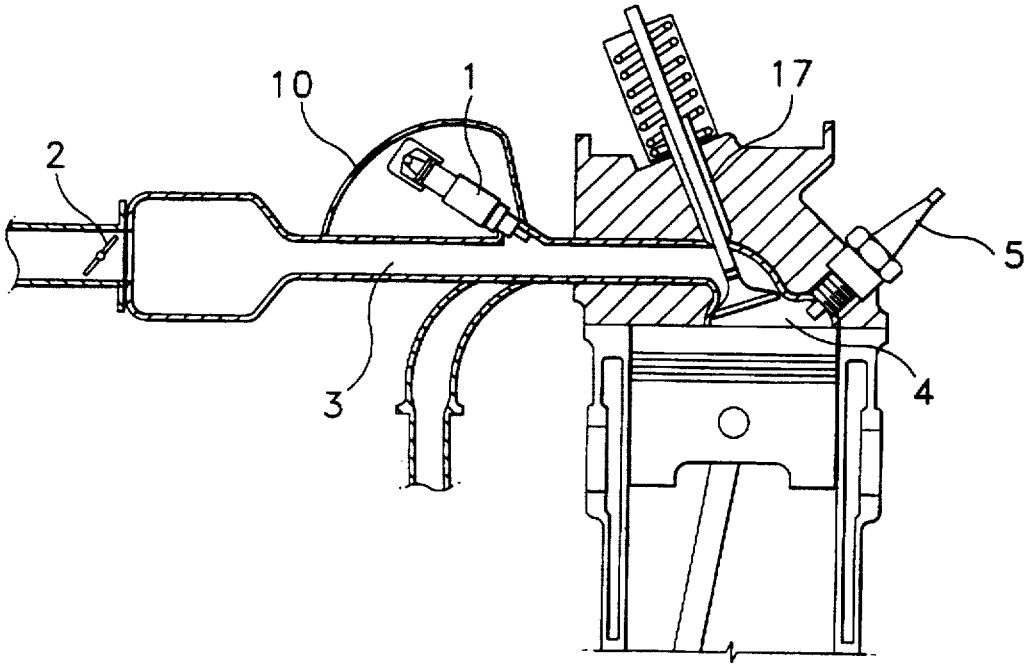
FIG. 4 is a schematic view illustrating a mounting state of an injector on an engine in accordance with a preferred embodiment of the present invention.

Referring first to FIG. 4, an injector 1 according to the present invention is mounted on an air intake manifold 3, comprising a throttle valve 2. The injector injects fuel into the intake manifold 3. The injector 1 is connected to a secondary air tube 10 to receive air from the intake manifold 3 so that part of the air required for combusting the fuel, and thus driving the engine, can be preliminarily mixed with the fuel in the injector 1. This preliminary mixture is then sprayed back into the intake manifold where it mixes with more air and this mixture goes on to the combustion chamber 4. The secondary air tube 10 communicates between with the intake manifold 3 and the injector 1.

Figure 5:
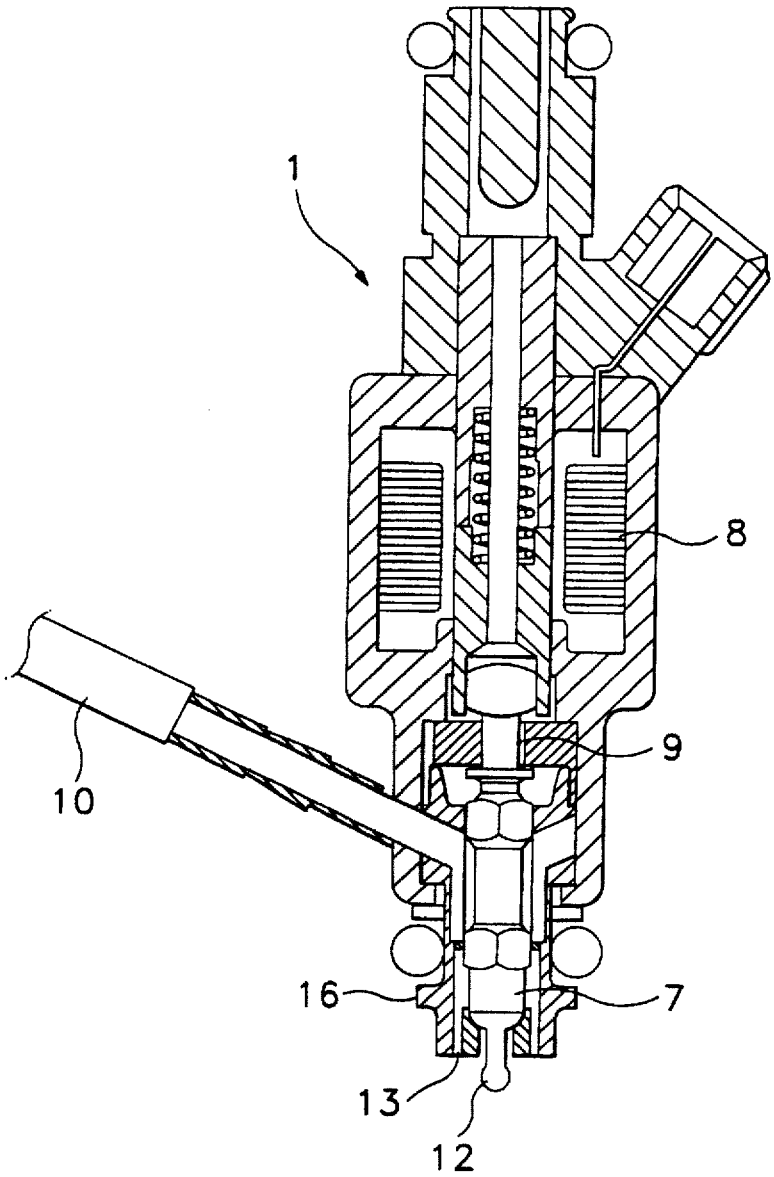
FIG. 5 is an enlarged sectional view of the injector depicted in FIG. 4.
Figure 6A:
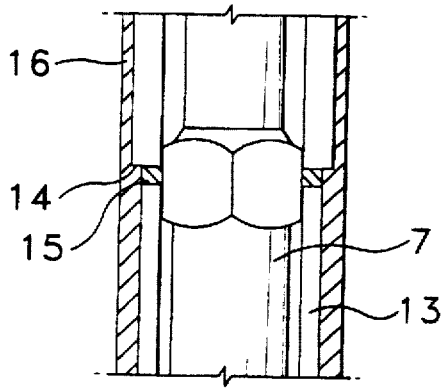
FIGS. 6A and 6B are sectional views illustrating an operating state of a needle valve of the injector depicted in FIG. 5.
Figure 6B:
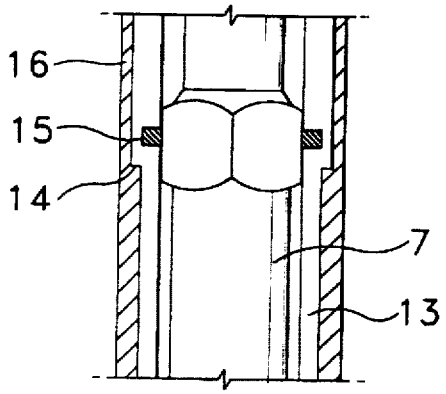

As shown in FIG. 5, the injector 1 is provided with a ring-shaped air passage 13 which is formed concentrically around a fuel passage terminating at its distal end in an injection hole 12 comprising a valve seat 16 receiving a needle valve 7. As shown in FIGS. 6A and 6B, air passage 13 is opened and closed by a ring-shaped valve 15 formed on an outer circumference of the fuel passageway in combination with a valve seat 14. The diameter of the ring-shaped valve 15 is slightly larger than or equal to that of the air passage 13.

When the engine is not running, the air passage 13 is closed by the ring-shaped valve 15 abutting the seat 14 as shown in FIG. 6A, and when the engine is running, by applying electricity to the solenoid coil 8 to magnetize it, a plunger 9 is lifted, thereby lifting the attached needle valve 7, and opening the air passage 13 by moving the ring-shaped valve 15 as shown in FIG. 6B. The valve seat 16 has a step (seat) portion 14 formed on the inner surface of the upper portion of the air passage 13 so that the air passage 13 can be opened by the lifting of the ring-shaped valve 15.

When the member 9 is lifted by the magnetization of the solenoid coil 8, fuel is injected into the intake manifold 3 through a nozzle 12, toward an intake valve 17. At the same time, air is also fed into the intake manifold 3 through the open air passage 13 toward the intake valve 17 through the open air passage 13.

Figure 8:
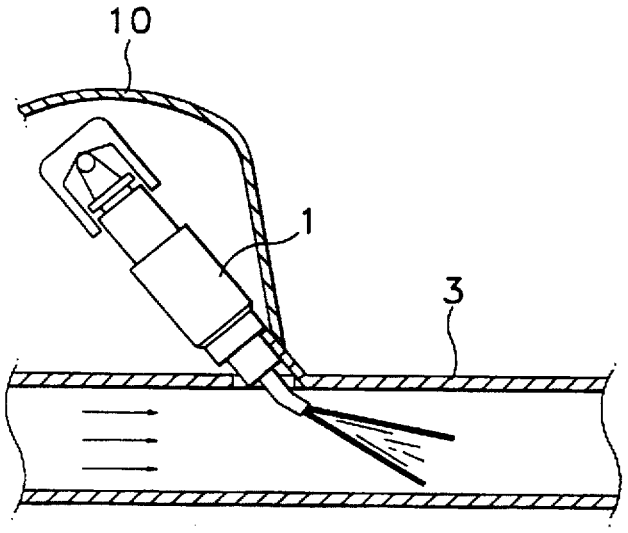
FIG. 8 is a schematic view illustrating the stratification of a mixture of fuel and air injected from an injector in accordance with a preferred embodiment of the present invention.

Accordingly, as shown in FIG. 8, fuel injected into the intake manifold 3 through the injector 1 is mixed with secondary air inducted from the intake manifold 3 and the mixture is sprayed into the intake valve 17 mounted on an outlet of the intake manifold 3.

As described above, when fuel is injected from the injector 1, the ring-shaped valve 15 selectively communicates the secondary air tube 10 with the air passage 13 in combination with the lifting movement of the plunger 9 provided in the injector 1.

When the injector 1 as described above is applied to a lean-burn engine, since the air passage 13 is defined concentrically around the plunger 9, fuel injected through the nozzle 12 of the needle valve 7 located at its distal end on the injection hole 12 formed on the valve seat 16 of the injector 1 is mixed with air induced from the air tube 10, thereby making it possible to achieve a lean burn.

Since air induced through the secondary air tube 10 is injected simultaneously with fuel from the injector 1 and surrounds the fuel, and this combination is further mixed with air inducted into the intake manifold 3 through the throttle valve 2, the final mixture which is to be injected into the combustion chamber comes to have an air-fuel ratio of about 25:1 which is suitable for lean-burning engines.

Figure 7:
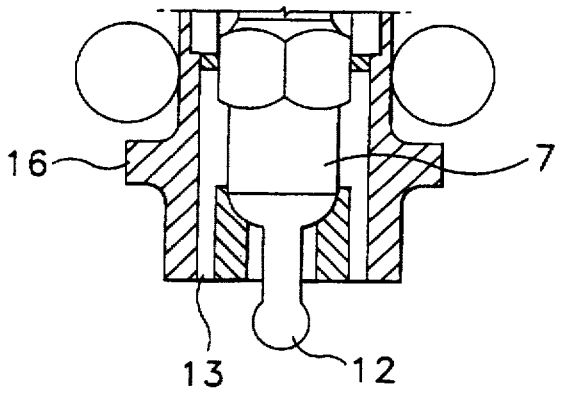
FIG. 7 is an enlarged view of an air passage formed on a valve seat of an injector depicted in FIG. 5.

Preferably, a front end of the air passage 13 is, as shown in FIG. 7, flared out to comply with an injection angle of the nozzle such that, when fuel is injected through the nozzle 12 of the needle valve 7, air fed from the air passage 13 can surround the fuel and air inducted from the throttle valve 2 can be stratified with the injected fuel.

While the present invention has been particularly shown and described with reference to the particular embodiments thereof, it will be understood by those skilled in the art that various changes in form and details may be effected therein without departing from the spirit and scope of the invention as defined by the appended claims.

What is claimed is:

1. A fuel injection system comprising:

an air intake manifold adapted to have air passing therethrough in a streamwise direction;

a fuel injector operatively connected to said manifold;

a subsidiary air tube operatively connected at one end to said manifold upstream of said connected fuel injector and at the other end to said fuel injector;

wherein said fuel injector comprises two passageways, one of which is adapted to pass fuel and the other of which is adapted to pass air;

a first valve assembly operatively associated with said fuel passageway;

a second valve assembly operatively associated with said air passageway; and means for opening and closing each of said valve assemblies;

wherein said second valve opening and closing means is operative to open said air passageway during at least some of the time that said first valve assembly, and therefore said fuel passageway, is open;

whereby said system being adapted to preliminarily mix fuel with air from said secondary air tube, to inject said preliminary mixture into admixture with additional air from said air intake manifold to form a final air-fuel mixture, and to inject said final mixture into operative proximity to an ignition system.

2. The fuel injection system as claimed in claim 1 further comprising:

a solenoid operatively associated with said first and second valve assemblies;

said first and second valve assemblies being disposed on a single longitudinal mounting operatively associated with said solenoid;

wherein when said solenoid is activated, said longitudinal member is retracted opening said first and second valve assemblies.

3. The fuel injection system as claimed in claim 1 wherein said first valve assembly is a needle valve.

4. The fuel injection system as claimed in claim 1 wherein said air passageways is concentric about said fuel passageway, and wherein said second valve assembly comprises a shoulder and valve seat combination.

5. The fuel injection system as claimed in claim 1 wherein said first and second valve assemblies are both open or closed simultaneously.

6. The fuel injection system as claimed in claim 1 further comprising:

a passageway in said injector which has at least two concentric sub-passageways;

wherein an internal of said concentric passageways is adapted to pass fuel and an external of said concentric passageways is adapted to pass secondary air;

said internal passageway being defined by a tube wall and terminating in a needle valve at the distal end thereof;

said external passageway being defined between an outwardly directed portion of said tube and an external wall;

an inwardly directed valve seat disposed on an inwardly directed portion of said external wall of said outer concentric passageway; and an outwardly extending air valve disposed on said outwardly directed portion of said tube wall, said valve being adapted to engage with, and disengage from, said valve seat by longitudinal motion of said tube;

wherein longitudinal motion of said tube closes and opens said needle valve and closes and opens said air valve.

* * * * *